United States Patent [19]

Brda

[11] Patent Number: 4,580,658

[45] Date of Patent: Apr. 8, 1986

[54] DEVICE FOR LOWERING A PERSON OR A LOAD ON A ROPE

[76] Inventor: Walter Brda, Breitenau 10, 8112 Bad Kohlgrub, Fed. Rep. of Germany

[21] Appl. No.: 554,257

[22] Filed: Nov. 22, 1983

[30] Foreign Application Priority Data

Nov. 27, 1982 [DE] Fed. Rep. of Germany ..... 3243952

[51] Int. Cl.[4] ..... A62B 1/14

[52] U.S. Cl. ..... 182/5; 182/193

[58] Field of Search ..... 182/5, 191–193, 182/3, 4, 6, 7, 71; 188/65.1–65.5

[56] References Cited

U.S. PATENT DOCUMENTS

| | | | |
|---|---|---|---|
| 209,137 | 10/1878 | Rotschka | 188/65.4 |
| 394,109 | 12/1888 | Fowler | 188/65.3 |
| 544,724 | 8/1895 | Cotton | 182/193 |

FOREIGN PATENT DOCUMENTS

| | | | |
|---|---|---|---|
| 046891 | 3/1982 | European Pat. Off. . | |
| 2448910 | 10/1980 | France | 182/5 |
| 631984 | 11/1949 | United Kingdom | 182/5 |
| 2044414 | 10/1980 | United Kingdom | 182/5 |

*Primary Examiner*—Reinaldo P. Machado
*Assistant Examiner*—Alvin Chin-Shue
*Attorney, Agent, or Firm*—Wolf, Greenfield & Sacks

[57] ABSTRACT

A device for lowering a person or a load on a rope which automatically arrests further movement of the person or load on the rope regardless of which direction the rope passes through the device, which is capable of accommodating ropes of different diameters. The device of this invention includes a friction cylinder disposed on a base plate, a friction body, and a pivotally mounted control lever. The rope is wrapped around at least a portion of the circumference of the friction cylinder and also around the friction body, and the rope thereafter passes between a concave braking surface disposed on the friction body and one end of the control lever. The end of the control lever is provided with two camming surfaces which are positioned on opposite sides of the axis of rotation of the lever. Regardless of the direction of movement of the rope, friction between one of the camming surfaces and the rope causes the rope to be wedged between that camming surface and the concave braking surface on the friction body. Free movement of the rope is permitted by manually positioning the lever in an intermediate position so that both camming surfaces are spaced from the concave braking surface.

5 Claims, 5 Drawing Figures

DEVICE FOR LOWERING A PERSON OR A LOAD ON A ROPE

FIELD OF THE INVENTION

This invention relates generally to a device for lowering a person or a load on a rope and, more particularly, concerns such a device having a friction cylinder disposed on a base plate, an additional friction body, and a pivotally mounted control lever, wherein the rope passes at least around a portion of the circumferences of the friction cylinder and of the friction body and passes between a surface of the friction body and the control lever, and wherein the control lever has a camming surface which the rope, as it slides past, engages by friction to pivot the control lever for automatic braking of the device on the rope.

BACKGROUND OF THE INVENTION

One type of device for allowing a person to descend by means of a rope is shown in U.S. patent application Ser. No. 296,374 filed Aug. 26, 1981, which corresponds to European Patent Application No. 81106095.3 (publication No. 0 046 891 A3, published Mar. 10, 1982). The embodiment of such a device, as illustrated in FIGS. 7 through 10 of this application, shows the rope first passing one and a half times around a friction cylinder and then passing over an additional friction body. In the process the rope is diverted by approximately 180°. The rope then passes along a flat braking surface on the additional friction body past a pivoting cam control lever which is biased against the rope by a spring. The rope always exerts a certain friction on the cam control lever while sliding between the braking surface and the control lever. The rope tends to pivot the control lever so that it wedges the rope between the braking surface and itself to bring the device to a standstill on the rope, provided that the control lever can move freely and is not arrested by a person intending to slide down the rope so that braking does not take place.

A disadvantage of this foregoing device is, first of all, that a spring is necessary to ensure functioning of the device. This spring is a weak point since it requires a functional examination at regular intervals to make sure the spring is not broken or rusty, or that the spring does not fail to function for any other reason when the device is being used after a long layaway. Also, the ability of the entire device to function hinges upon the proper functioning of the spring.

The embodiment of FIGS. 1 through 7 of the aforementioned application avoids this disadvantage by allowing the additional friction body, around which the rope passes, to pivot eccentrically so that it pivots during circulation of the rope and wedges the rope between itself and a braking surface, thereby arresting further movement of the rope. However, this device of FIGS. 1 through 7 is cumbersome and expensive. This device is also prone to failure when used in a rough environment since, where descent by rope is desired, force must be transferred from a control lever via a gear to the additional friction body to counteract the braking force of the additional friction body. Contamination of these gears may jeopardize functionality, and a number of precisely machined parts with close tolerances is required.

Known devices which allow persons to descend by means of a rope are not optimally simple. In addition, all of the following requirements for operational safety are not satisfied in known devices:

(a) the device should be usable with ropes having different diameters, within limits; the device should especially tolerate a diameter change arising from an increase in the diameter of the rope as a result of water absorption;

(b) mechanical parts prone to failure such as springs and gear wheels are to be avoided;

(c) the control lever, including the eccentrically mounted area needed for braking, should be easily interchangeable so that the device can be used with different ropes or rope diameters having larger differences than mentioned in paragraph (a);

(d) speed control should be precise;

(e) braking should occur even when the rope is accidentally inserted incorrectly, for instance, when the rope runs past the control lever in a direction other than the desired direction;

(f) braking should take place even when the person using the device reacts incorrectly (that is, when he or she pulls or pushes the control lever to brake instead of letting it go); and (g) the device should be operable in different ways, i.e., for descending on the rope and for operating with the device locked in place.

SUMMARY OF THE INVENTION

One object of this invention is to provide a device of the above-identified type for allowing a person or load to descend on a rope which meets the above-referenced requirements. These requirements of greater operational safety and simplicity are of paramount importance. This invention achieves this object by providing a concave braking surface extending in the direction in which the rope runs on an additional friction body, and by providing a control lever fitted with two camming surfaces on its end which are opposite the concave braking surface.

In this manner, braking occurs even when the lever is accidentally pushed or pulled in the wrong direction instead of being released. Braking occurs even with different rope configurations, since self-braking occurs when the rope slides past the camming surfaces of the control lever in either direction. Furthermore, the control lever with the camming surfaces is easily replaced, since it is a simple part and is mounted in a simple manner. The control lever may be replaced if ropes with greatly differing diameters are to be inserted. Even without replacing the control lever, this device will work with ropes of somewhat variable diameters, since the rope is stretched along the concave surface of the friction body, always in such a way that it will invariably engage a camming surface of the control lever so that self-braking by wedging takes place.

BRIEF DESCRIPTION OF THE DRAWINGS

The objects, advantages, and features of this invention will be more clearly appreciated from the following detailed description, taken in conjunction with the accompanying drawing in which.

DETAILED DESCRIPTION OF THE PREFERRED EMBODIMENT

Figure 1:
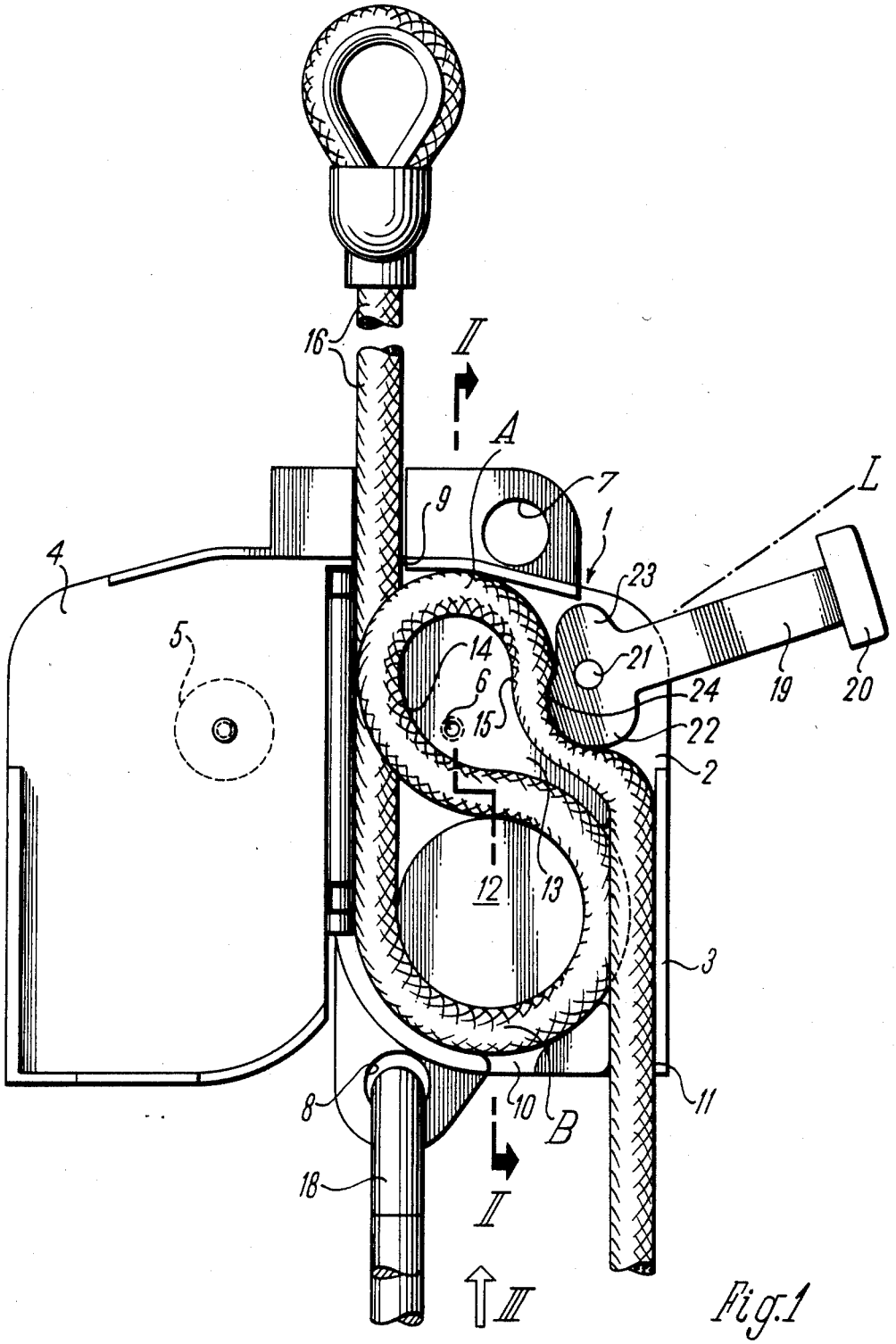
FIG. 1 is a side view of one embodiment of this invention showing the interior of the housing.
Figure 3:
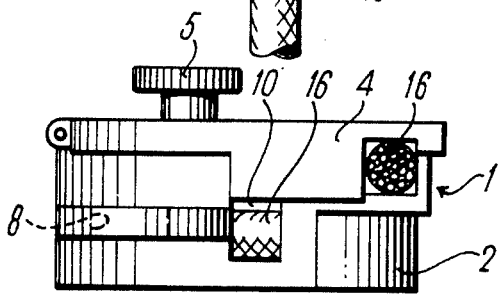
FIG. 3 is a bottom view taken in the direction of arrow III of FIG. 1.

With reference now to the drawing, and more particularly to FIG. 1 thereof, there is shown a device for allowing a person or load to descend by means of a rope. The device of FIG. 1 includes housing 1 which is comprised of base plate 2 and edge portions 3. The interior of the housing is shown in FIG. 1 in which lid 4 is illustrated in its raised position. Lid 4 is hinged on the housing, and with reference to FIG. 1, lid 4 is pivoted to the right to close it. Locking is accomplished by screwing knurled knob 5 tightly into threaded hole 6 (see FIG. 3).

Base plate 2 has first opening 7 on its top and a second opening 8 on its bottom, and which of these openings 7 and 8 are used depends upon the manner in which the operator slides down the rope, as will be described. Edge portions 3 have first opening 9, second opening 10, and third opening 11.

Stationary friction cylinder 12 is disposed inside the housing. Above friction cylinder 12 is disposed additional friction body 13, which is also stationary. Friction body 13 is roughly shaped like a tear drop and body 13 has a lower convex surface 14, and upper concave braking surface 15 is disposed above and along the side of body 13.

Disposed opposite concave surface 15 of friction body 13 is control lever 19, which can be operated by manual use of hand grip 20. Control lever 19 is pivotally mounted on pivot bearing 21 and has two camming surfaces 22 and 23 on the end which faces toward concave surface 15. Camming surfaces 22 and 23 are formed on portions of the end of lever 19 so that the distance between each of the camming surfaces 22 and 23 and the axis of rotation at pivot bearing 21 is greater than the distances between other neighboring surfaces on the end of lever 19 and the axis of rotation of pivot bearing 21. The configurations of camming surfaces 22 and 23 are such that when control lever 19 is pivoted either downwardly or upwardly, as the case may be, the respective camming surfaces 22 or 23 will move towards concave surface 15 to decrease the distance between the respective camming surface and the concave surface. Camming surfaces 22 and 23 are disposed generally on opposite sides of pivot bearing 21. It is necessary that another surface of control lever 19 is disposed between cams 22 and 23 and that the distance of this other surface from the axis at pivot bearing 21 is less than the distances between the axis at pivot bearing 21 and each of the two camming surfaces 22 and 23.

Figure 5:
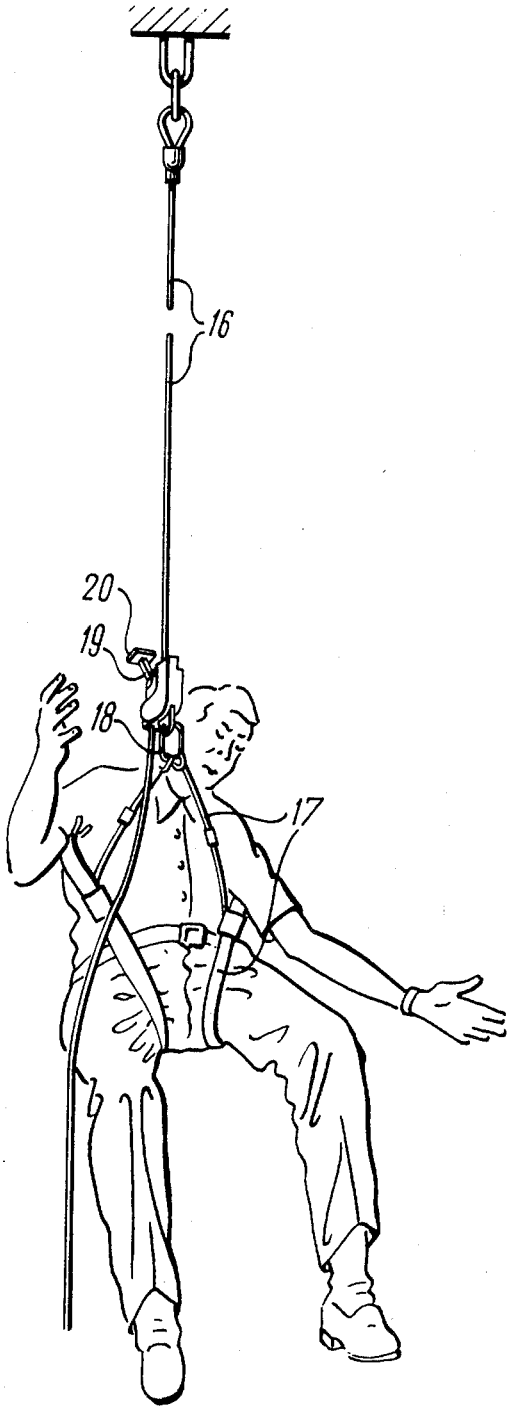
FIG. 5 is a pictoral representation showing the operation of the device of this invention.

In FIG. 1, rope 16 is positioned within housing 1 in such a way that a descent on the rope may occur, which means that, as shown in FIG. 5, the upper end of rope 16 is attached to a fixed point. The person planning to descend on the rope hangs from a belt 17 which is hooked onto housing opening 8 in base plate 2 by a trigger snap. Rope 16 passes from below through opening 11 and into housing 1. Rope 16 then passes over friction body 13. Rope 16 passes first over concave surface 15 and then around convex surface 14 after being diverted by approximately 180°. Then rope 16 encircles cylindrical friction cylinder 12 through an arc of approximately 270° (three-quarters of a circle) and passes upwardly from there through opening 9 and out of housing 1.

Figure 2:
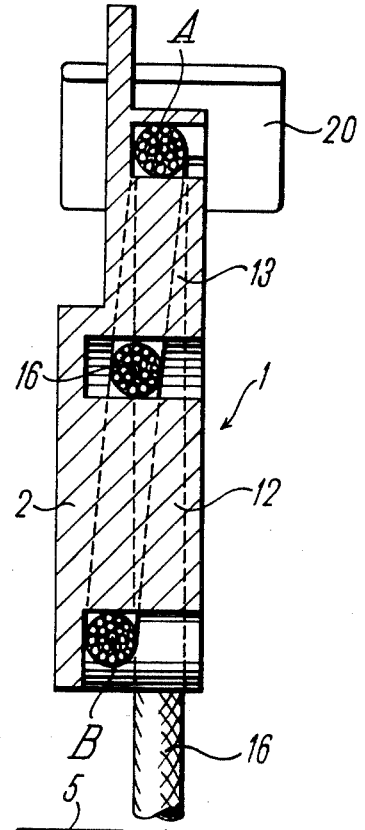
FIG. 2 is a cross-sectional view taken along line II—II of FIG. 1.

The rope moves in two planes. As shown in FIG. 2, the wall of base plate 2 is slanted so that the path of the rope shifts laterally an amount roughly equal to one rope diameter in a direction perpendicular to the plane of FIG. 1 from the uppermost location A where the rope is diverted around friction body 13 to lower location B, where the rope passes around the bottom of friction cylinder 13.

Two operational positions of lever 19 are available in the arrangement shown in FIGS. 1 and 5. In the first operational position, the person descending on the rope releases control lever 19. The person is attached to the device at opening 8 by belt 17 and trigger snap 18, and the weight of the person pulls the device downwardly. As a result, there is a tendency for rope 16 to be pulled upwardly, out of opening 9. The rope also moves from below upwardly through opening 11, and the rope first passes between camming surface 22 and the concave surface of friction body 13. At this point, the rope engages camming surface 22 by the rope by friction and camming surface 22 is pivoted in a clockwise direction, as shown in FIG. 1, so that the distance between camming surface 22 and concave surface 15 decreases. Control lever 19 thus is pivoted into the position depicted in FIG. 1, in which rope 16 is wedged tightly between camming surface 22 and concave surface 15. The device therefore comes to a halt on the rope without the need to use control lever 19.

In the second operational position, the person descending on the rope pivots control lever 19 upwardly to a position where it is approximately parallel to dash-dotted line L. In this position, the distance between concave surface 15 of friction body 13 and the surfaces of control lever 19 is such that rope 16 can pass between the friction body and the control lever without being wedged. The rope passes upwardly to location A, where it is diverted, thereafter passing over convex surface 14 of friction body 13. Then the rope makes a three-quarter turn around friction cylinder 12 and finally passes upwardly through opening 9 and out of housing 1. The rope is partially braked, although not to a complete halt, by its movement around friction body 13 and friction cylinder 12.

Camming surface 22 and surface 15 must be matched and configured with reference to the expected weight of a person using the device so that the person's weight is great enough to allow the rope to just barely pass through the device at the desired initial speed when control lever 19 is in position L. Camming surface 22 and surface 15 must be positioned so that when control lever 19 is in position L, enough braking occurs so that the rope moves through the device quietly at an assured, steady, and not too great speed, and so that control lever 19 possesses enough slack so that it can be turned counterclockwise for a precise regulation of the speed.

Figure 4:
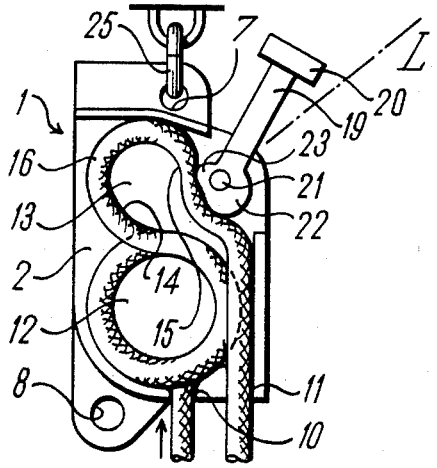
FIG. 4 is a schematic side view of the embodiment of FIG. 1 showing a further operational mode.

FIG. 4 shows another embodiment of this invention wherein the rope is inserted so that the device is fastened at opening 7 to a certain fixed point by trigger snap 25.

In FIG. 4, rope 16 passes into the device from below instead of from above, and additionally passes out of the device at the bottom. In the embodiment of FIG. 4, the rope may move in both directions. In one example of the embodiment of FIG. 4, the rope enters opening 10 from below and then passes one and a half times around friction cylinder 12. Thereafter, the rope first passes over convex surface 14 of friction body 13, around concave surface 15, and then down again through opening 11 and out of the device. Here, the rope engages, through friction, camming surface 23 of control lever 19, so that lever 19 is pivoted counterclockwise as shown in FIG. 4, and the distance between cam 23 and concave surface 15 of friction body 13 is decreased and the rope is tightly wedged.

The placement of control lever 19 with two camming surfaces 22 and 23 opposite the concave surface permits the insertion of the rope into the device in different ways. In every case or in both directions of movement, the rope is automatically braked by being tightly wedged by one of the two cams, and the rope can be made to again move through the device by manually pivoting the control lever into position L.

This device can operate with ropes of different diameters. Because friction body 13 has a concave shape opposite camming surfaces 22 and 23 (concave surface 15), the rope is always stretched in this area so that it is pressed onto one of the two camming surfaces 22 or 23 and so that the rope pivots lever 19 through friction far enough so that the rope is automatically braked by being wedged in place.

What is claimed is:

1. A device for lowering a person or a load on a rope, said device comprising:

a housing having a base plate;

a friction cylinder fixedly secured to said base plate;

a friction body fixedly secured to said base plate, said friction body having a concave braking surface facing away from said friction cylinder, the rope passing over said concave braking surface; and a control lever pivotally mounted on said base plate, said control lever being mounted independently of said friction cylinder and said friction body and being pivotally disposed with respect to said friction cylinder and said friction body, said control lever having a handle portion extending from said housing adapted to be manually grasped and a second end having two camming surfaces formed thereon in generally confronting, spaced relation with said braking surface of said friction body, the rope being at least partially wound about said friction cylinder and said friction body, whereby said concave braking surface of said friction body is configured to urge the rope into continual frictional engagement with at least one of said camming surfaces of said second end of said control lever, said one of said camming surfaces being driven toward said braking surface by pivoting of said lever in one direction by frictional engagement with the rope as the rope moves in a first direction to wedge the rope between said one camming surface and said braking surface, said lever being manually pivotable in another direction opposite of said one direction to capture the rope between said other camming surface and said concave braking surface.

2. A device as recited in claim 1 wherein said first camming surface and said second surface are disposed on generally opposite sides of an axis about which said lever pivots.

3. A device as recited in claim 1 wherein said friction body further comprises a generally convex shaped surface, disposed on a side of said body opposite of said braking surface facing said friction cylinder.

4. A device as recited in claim 3 wherein a portion of the rope passes on a tangent from said friction cylinder toward and over said convex surface of said friction body.

5. A device for lowering a person or a load on a rope, said device comprising:

an enclosed housing having a base plate and a lid for providing access to the interior of said housing;

a friction cylinder non-rotatably secured to said base plate within the interior of said enclosed housing, the rope being wrapped around at least a portion of the circumference of said friction cylinder;

a friction body secured to said base plate in spaced relation with said friction cylinder within the interior of said enclosed housing, said friction body having a convex surface formed on one side thereof facing said friction cylinder and a concave surface formed on a generally opposite side thereof, the rope passing on a tangent from said friction cylinder to and over said convex surface and thereafter passing around said friction body to said concave surface; and a control lever pivotally mounted to said base plate by a pivot bearing independently of said friction cylinder and said friction body, said control lever having a handle portion extending outwardly from said housing and two camming surfaces disposed on an end opposite of said handle portion, said two camming surfaces being positioned on generally opposite sides of said pivot bearing in generally spaced, confronting relation with said concave surface of said friction body, said concave surface of said friction body being configured to urge the rope into continual frictional engagement with at least one of said camming surfaces on said control lever, movement of the rope in a first direction engaging said one of said camming surfaces by friction and causing said lever to pivot in one direction with respect to said friction cylinder and said friction body to move said one camming surface toward said concave surface and the other camming surface away from said concave surface to tightly capture the rope between said one camming surface and said concave surface, movement of the rope in a second direction opposite of said first direction engaging the other camming surface by friction and causing said lever to pivot in another direction opposite of said one direction with respect to said friction body and said friction cylinder to move said other camming surface toward said concave surface and said first camming surface away from said concave surface to tightly capture the rope between said other camming surface and said concave surface, said lever being manually positionable in an intermediate location to space both said one and said other camming surfaces from said concave surface sufficiently to allow the rope to pass therebetween.

* * * * *